US007682321B2

(12) United States Patent
Naldoni

(10) Patent No.: US 7,682,321 B2
(45) Date of Patent: Mar. 23, 2010

(54) SKIN MASSAGE DEVICE

(75) Inventor: Moreno Naldoni, Scandicci (IT)

(73) Assignee: General Project S.R.L., Montespoertoli (IT)

( * ) Notice: Subject to any disclaimer, the term of this patent is extended or adjusted under 35 U.S.C. 154(b) by 0 days.

(21) Appl. No.: 10/552,294

(22) PCT Filed: Mar. 31, 2004

(86) PCT No.: PCT/IB2004/000982

§ 371 (c)(1),
(2), (4) Date: May 31, 2006

(87) PCT Pub. No.: WO2004/087034

PCT Pub. Date: Oct. 14, 2004

(65) Prior Publication Data

US 2006/0235339 A1 Oct. 19, 2006

(30) Foreign Application Priority Data

Apr. 1, 2003 (IT) ..... BO2003A0186

(51) Int. Cl.
*A61H 7/00* (2006.01)

(52) U.S. Cl. ..... 601/10; 601/6

(58) Field of Classification Search ..... 601/2, 601/6, 7, 9–11, 14, 84; 604/313, 315, 316; 15/384, 389
See application file for complete search history.

(56) References Cited

U.S. PATENT DOCUMENTS

| | | | | | |
|---|---|---|---|---|---|
| 904,650 | A | * | 11/1908 | Sampson | 15/110 |
| 1,460,927 | A | * | 7/1923 | Thompson et al. | 601/6 |
| 5,295,982 | A | | 3/1994 | Schatz | |
| 5,358,467 | A | * | 10/1994 | Milstein et al. | 601/10 |
| 5,377,701 | A | * | 1/1995 | Fang | 132/271 |
| 5,665,053 | A | | 9/1997 | Jacobs | |
| 6,500,141 | B1 | | 12/2002 | Irion et al. | |
| 2007/0066919 | A1 | * | 3/2007 | Gueret | 601/138 |

FOREIGN PATENT DOCUMENTS

DE 43 04 091 8/1994

* cited by examiner

*Primary Examiner*—Justine R Yu
*Assistant Examiner*—Kristen C Matter
(74) *Attorney, Agent, or Firm*—Ladas and Parry LLP

(57) ABSTRACT

A skin massage device having a handset connected to a machine body. The handset in turn has a chamber closed by a deformable membrane which adheres to a patient's skin by virtue of a vacuum generated in the chamber by a vacuum generating device. The device also has an electronic device for producing a variable vacuum in the chamber to deform the membrane and so lift, fold, compress, and smooth the patient's skin as to perform the massage cycle set by the operator.

13 Claims, 9 Drawing Sheets

SKIN MASSAGE DEVICE

TECHNICAL FIELD

The present invention relates to a skin massage device for cosmetic and therapeutic applications.

The device according to the invention performs mechanical massage of variable intensity, which can be adapted to a wide range of requirements for both cosmetic and therapeutic applications.

The non-invasive, skin-suction-assisted massage device according to the invention therefore provides for effectively treating various defects, such as cellulite, localized fatty deposits, relaxed tissue, etc.

BACKGROUND ART

In devices normally used for applications of this sort, mechanical massage of the skin is performed using revolving bodies of various forms (rollers, balls), often rotated electronically, or by vibration of appropriately shaped rigid surfaces, or using variously shaped hollow bodies in which a vacuum is formed.

In U.S. Pat. No. 6,196,982, massaging is performed using a vacuum which draws a portion of the skin onto an elastomeric surface which, subjected to the action of a vibration-generating device, performs the desired massage.

The principles on which the device in U.S. Pat. No. 6,196,982 is based, however, fail to provide for effective, vigorous skin massage.

One of the characteristics of the device according to the present invention is a membrane, in particular an elastomeric membrane.

The membrane replaces the rigid bodies which, as stated, usually revolve, and which, when set in motion, produce the actual massage effect of known devices.

The membrane used in the invention may be of varying rigidity, e.g. depending on the thickness and type of elastomeric material employed, and, while providing for softer contact with the skin as compared with rigid elements of any form, has projections or recesses on its outer surface enabling it to exert significant pressure on the skin.

More specifically, the membrane in the present invention is fixed along the edge of a chamber forming part of a handset, and, in addition to lifting a portion of skin, is moved back and forth by a variable vacuum generated by a vacuum pump, and the pattern of which may be determined, for example, by opening and closing two electronically controlled solenoid valves.

The membrane also has holes by which to also transmit the vacuum to the skin, once sufficient airtight sealing is achieved by pressing the raised edge of the membrane lightly on the patient's skin. One or more folds are thus formed in the skin and kneaded by alternating suction on the membrane, which also has tissue-folding projections and recesses.

Another characteristic of the present invention is that of employing a vacuum device capable, in particular, of performing pulsating skin treatment cycles.

By virtue of various preset treatment programs, defects can therefore be treated specifically according to the degree of advancement and the area of the body involved. Effects range from remodelling, with or without weight loss, combined with improved physical appearance and skin tone, to a reduction in body dimensions. The present invention is also designed for physiotherapy and rehabilitation in the treatment of traumas and connective tissue diseases, and is also so effective in improving arterial-venous and lymphatic microcirculation as to cure lymphoedemas and poor microcirculation.

In the present invention, employing a pneumatic circuit for producing a controlled vacuum is instrumental in enabling automatic mechanical massage. In the known art, direct contact between the suction source and the skin is potentially dangerous, and may result in pain and irritation by sharp exposure of the skin tissue to the vacuum.

Interfacing the patient's body exclusively by means of the membrane, however, reduces pain caused by suction, and prevents direct contact between the skin and the vacuum chamber.

The handset can be moved manually over the tissue portion for treatment, after first coating the patient's skin with oil or other lubricating means.

As the handset slides over the skin, the tissue portion adhering to the membrane is therefore raised, folded, smoothed and compressed vigorously according to the program selected by the operator, so that the tissue is modelled and transferred in a wavelike motion, with beneficial effects at connective tissue layer level.

Revolving bodies or vibrating surfaces, such as those of known devices, also pose a serious hygiene problem, by being fixed and therefore used for different patients. Apart from the time factor involved, thorough, continual disinfection of such parts is also technically complex, by frequently involving automatic mechanical devices.

Conversely, the membrane used in the present invention is easily replaceable, and may therefore be changed for each patient.

To ensure the utmost hygiene, it is therefore proposed that the membrane be used once, and may be changed after each treatment. In other words, the membrane may be disposable and made of non-allergenic, easily disinfectable material.

Another drawback of known marketed devices is that of only performing mechanical treatment, with no regard to other equally straightforward, controllable forms of tissue treatment. Particularly interesting is the possibility of combining the effects of the massage element with those of an ultrasound device, thus exploiting, not only the purely mechanical action performed by the membrane, but also the known mechanical, thermal, chemical and cavitational effects produced by ultrasound on biological tissue.

The device according to the present invention is an electric medical device for performing in-depth, non-invasive mechanical massage, which, by the combined action of suction and the membrane with specially shaped projections, lifts and manipulates the skin and subcutaneous tissue, and is specially designed to simulate the so-called "knead-and-roll" manual massage method widely used by physiotherapists and masseurs.

The physiological effects produced by the device according to the present invention are as follows.

The tissues for treatment are "separated" by suction and immediately subjected to vigorous mechanical massage, which stimulates venous and lymphatic circulation of the treatment area, thus improving cutaneous and subcutaneous nutrition, and in particular provides for reabsorbing stagnant liquids and mobilizing subcutaneous fat. Recent findings, in fact, show that even light mechanical stress is sufficient to break down fat cells, which release triglycerides and fatty acids, and are distributed evenly over a much wider area. The main effect is that of stimulating tissue metabolism and vascularization, followed by lymph drainage and tissue purification, the latter assisted by the high degree of mobility of the fluid inside the tissue.

The device according to the present invention greatly increases subcutaneous flood flow, by the mechanical massage action being directed locally on the treatment area.

The most significant histological change induced by the mechanical massage performed by the device is the accumulation of longitudinal collagen bands in the subcutaneous tissue. This is accompanied by some deformation of the fat cells, and both the above architectural variations occur with no inflammation or repair reaction. Redistribution of the vertical force component, by longitudinal collagen bands depositing parallel to the skin surface, and breakdown of the vertical fascia fibres assist in reducing the appearance of cellulite in the treated tissue.

Ultrasound action is also extremely important, and is combined with that of the massage membrane in one embodiment of the present invention. The interaction of ultrasound with biological tissue produces various effects, as described in detail below.

Therapeutically, ultrasound provides mainly for pain relief, muscle relaxation, and fibrolytic and nutrition effects. These are due partly to the increase in temperature produced by absorption of viscosity-related heat, in turn produced by thermal conductivity and chemical absorption, and partly to mechanical micromassage of the tissue.

The increase in temperature also has a vasodilatory effect, which assists catabolite removal and supplies the tissue with nutritional substances and oxygen. Ultrasound thus improves tissue nutrition, assists in repairing damaged tissue, and accelerates resolution of inflammation processes.

Ultrasound oscillation of the tissue particles breaks up the collagen fibres of fibrous tissue. Dispersion and separation of the collagen fibres and softening of the cement are used to assist reabsorption of organized haematomas and to soften tissue; which effects, together with an overall feeling of well-being, make ultrasound ideal for the purpose in question.

Another advantage of the present invention is that, according to recent studies, ultrasound attenuation is reduced alongside an increase in skin deformation, as a result of collagen fibre redistribution. Combined with mechanical massage, ultrasound therefore provides for greater in-depth massage of the treated tissue.

DISCLOSURE OF INVENTION

It is therefore an object of the present invention to provide a skin massage device designed to eliminate the aforementioned drawbacks, and as claimed in Claim 1.

BRIEF DESCRIPTION OF THE DRAWINGS

A number of non-limiting embodiments of the present invention will be described, by way of example with reference to the accompanying drawing, in which.

BEST MODE FOR CARRYING OUT THE INVENTION

In the following disclosure, only the details required for a clear understanding of the present invention will be described and numbered.

Figure 1A:
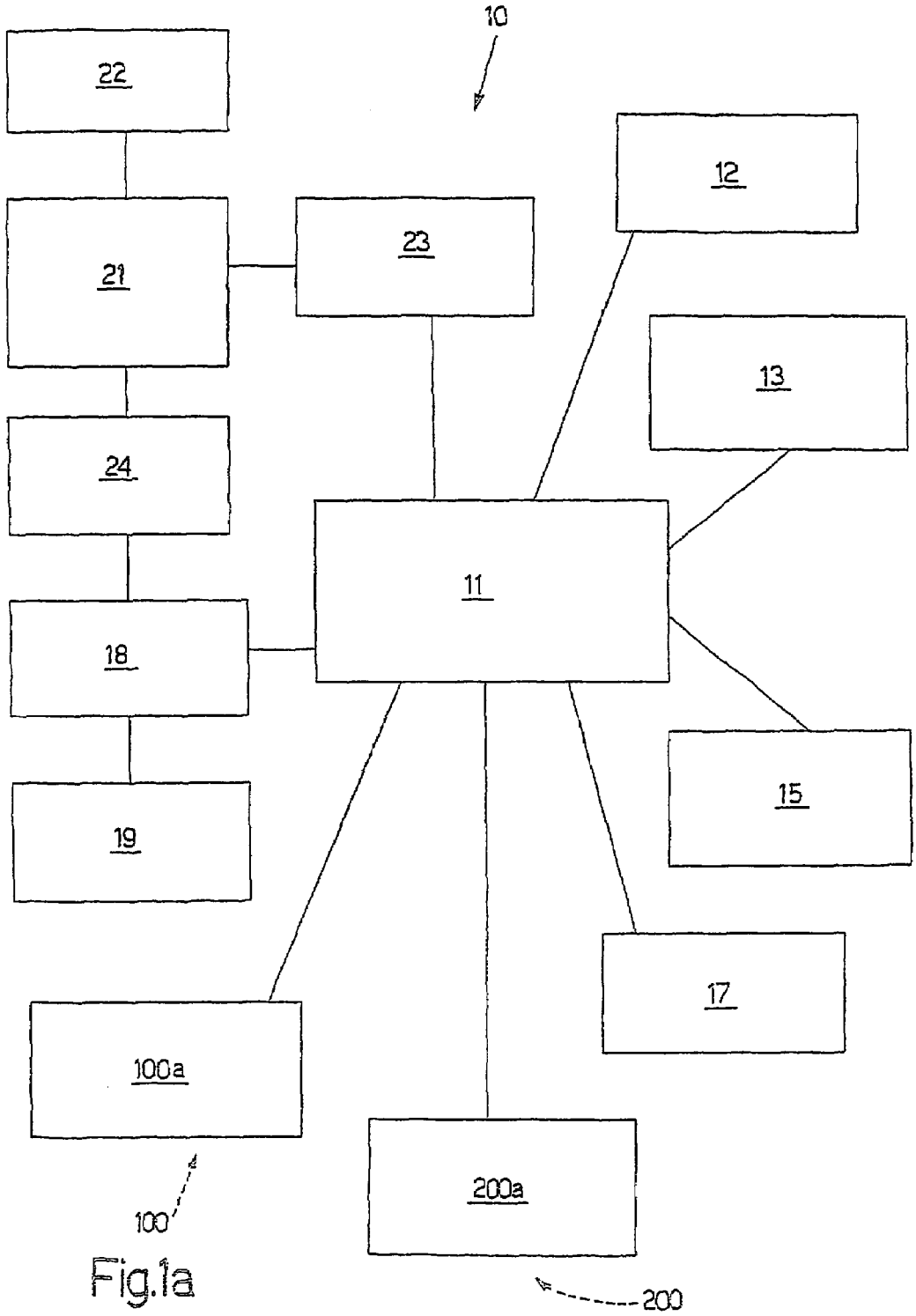
FIG. 1*a* shows a block diagram of the electric system of the device according to the present invention.
Figure 1B:
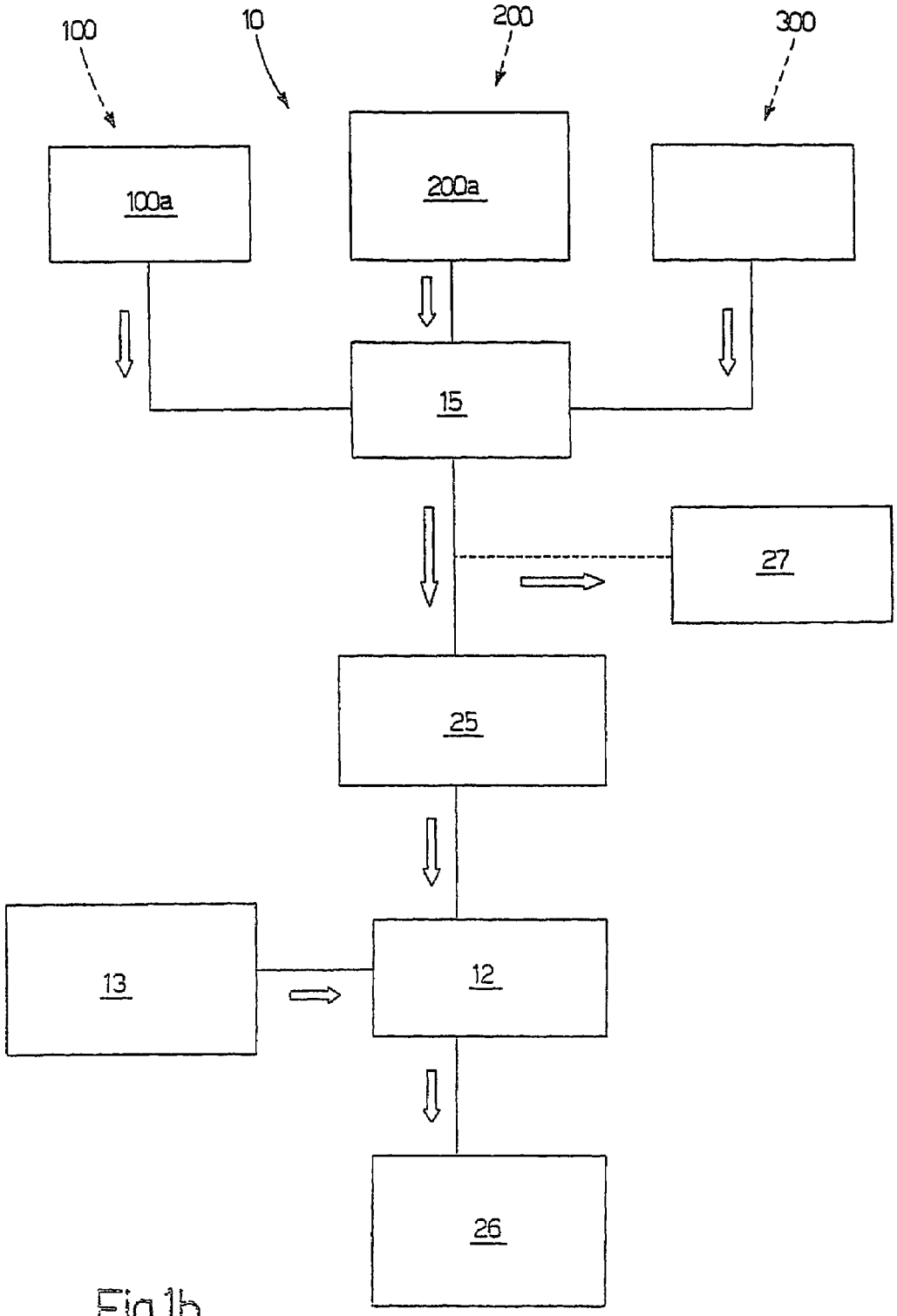
FIG. 1*b* shows a block diagram of the pneumatic system of the device according to the present invention.

Number 10 in FIGS. 1*a* and 1*b* indicates schematically a skin massage device in accordance with the present invention.

The core of the FIG. 1*a* electric system is represented by an electronic central control unit 11 which controls the entire system. More specifically, electronic central control unit 11 controls turn-on of a vacuum pump 12, timed operation of a pulsating air generator 13, the setting of a handset operation selector 15, and enabling of the various treatment programs, some of which are preset and memorized, while others are set directly by the operator.

Electronic central control unit 11 is connected to a user interface 17 comprising, internally, an electronic card (not shown) for controlling function and time display by two digital displays on the handset (see below), and operator treatment parameter selection by means of a number of buttons (not shown).

Electronic central control unit 11 is also connected electrically to an ultrasound generator 18, and in fact controls the ultrasound emission mode and frequency of a generator 18 on a second body treatment handset (see below) which also has a therapeutic terminal 19 for controlling ultrasound generator 18.

Two main body treatment handsets 100, 200 have further two cards 100*a*, 200*a* (FIG. 1*a*) also connected electrically to electronic central control unit 11.

More specifically, a card 100*a* is provided for a first handset 100 having no ultrasound generator, and a card 200*a* is provided for a second handset 200 equipped with an ultrasound generator (see below).

By means of card 100*a* (or 200*a*), program selection and treatment time are also displayed on the handset 100 (or 200) by a small four-figure digital display (see below), and vacuum pump 12 is turned on-off directly from handset 100 (or 200).

Device 10 also comprises a third handset 300 (FIG. 1*b*) smaller than the other two (100, 200) and designed for facial applications.

Device 10 is complete with two transformers 23, 24, and is powered by a single-phase, 230V, 50 Hz external power mains.

A switch 21 is interposed in known manner between transformers 23, 24 and mains 22.

As shown in FIG. 1*b*, device 10 also comprises a filtration stage 25 for retaining impurities, in particular rarefied particles of oil used in the treatment; and a filtered-air exhaust stage 26.

Device 10, and in particular handsets 100, 200 and 300, may be equipped with a vacuum release device 27 for immediately releasing the vacuum, and restoring atmospheric pressure, in the pneumatic system to rapidly eliminate the skin-lifting action.

Device 10 operates as follows:

by means of interface 17, the user activates vacuum pump 12 to create a vacuum in the pneumatic circuit (not shown), which is closed once handset 100, 200 or 300 is placed on the skin;

operation of pulsating-air generator 13 reduces the vacuum in the pneumatic circuit by variable amounts;

selector 15 provides for changing the final branch of the pneumatic circuit, by connecting the main portion to only one of the three handsets 100, 200, 300 at a time; in other words, the three handsets 100, 200, 300 are connected simultaneously to the machine body (not shown), and can be operator-selected one at a time by means of interface 17 and selector 15.

As stated, 100 indicates a first embodiment of a handset usable in device 10 according to the present invention.

Handset 100 comprises a hollow main body 101 defining an inner chamber 102 having a bottom edge 102*a*.

Chamber 102 is closed at the bottom by a specially designed membrane 103, the function of which is explained in detail later on.

More specifically, membrane 103 has a peripheral groove 103*a* into which the bottom edge 102*a* of chamber 102 is inserted.

Once bottom edge 102*a* is inserted inside groove 103*a*, membrane 103 is tightened hermetically to main body 101 by means of a metal ring 104.

Figure 2:
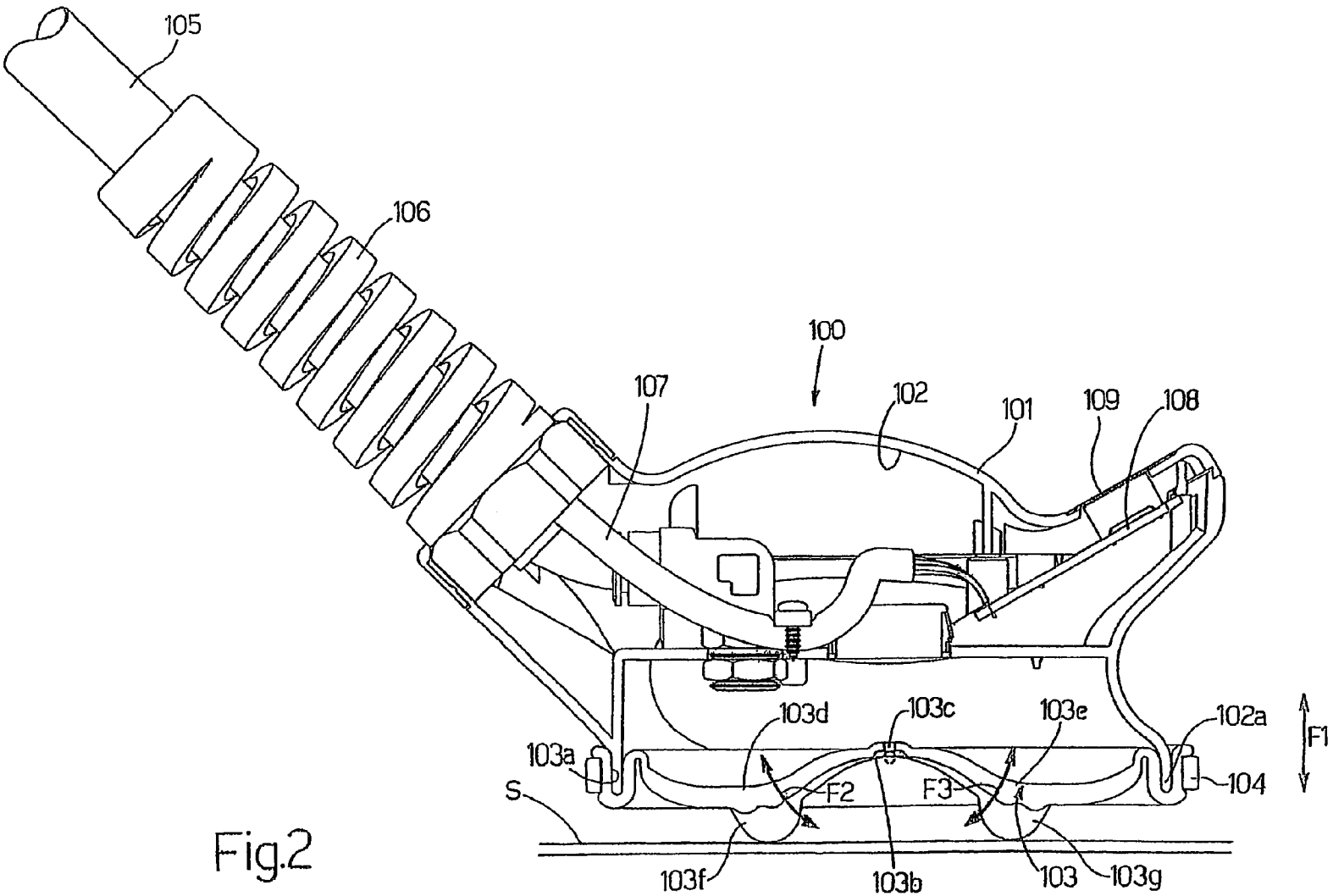
FIG. 2 shows a first embodiment of a handset of the FIG. 1 device.

Being advantageously made of elastomeric material, membrane 103 is deformed slightly radially when ring 104 is pushed by the operator in the directions indicated by the double arrow F1 (FIG. 2). By means of this simple system, membrane 103, which may advantageously be disposable, is fixed to and removed from handset 100.

Membrane 103 has a central portion 103*b* having a number of holes 103*c*; and two lateral portions 103*d*, 103*e* thicker than central portion 103*b* and each having two projections 103*f*, 103*g* respectively.

Further details concerning the design of membrane 103 are given below.

Handset 100 is connected pneumatically to the FIG. 1*b* pneumatic circuit, and in particular to vacuum pump 12, by a conduit 105 (FIG. 2), the connection portion of which to handset 100 is subjected to the action of an elastic member 106 coiled about conduit 105 to keep conduit 105 erect.

An electric cable 107 extends inside pneumatic conduit 105, and powers a liquid-crystal display 108, on which information is readable through a window 109 covered with a layer of transparent material.

Handset 100 may also comprise a key (not shown) for turning the device according to the invention on and off; and a key (not shown) for fast vacuum release to detach the handset quickly and painlessly from the patient's skin (see device 27 in FIG. 1*b*).

Externally, main body 101 of handset 100 is designed to permit firm, easy grip by the operator.

FIG. 2 shows membrane 103 placed on the skin S of a patient (not shown).

In the FIG. 2 situation, the treatment cycle of skin S has not yet started, so that skin S lies in a substantially horizontal plane.

Figure 7:
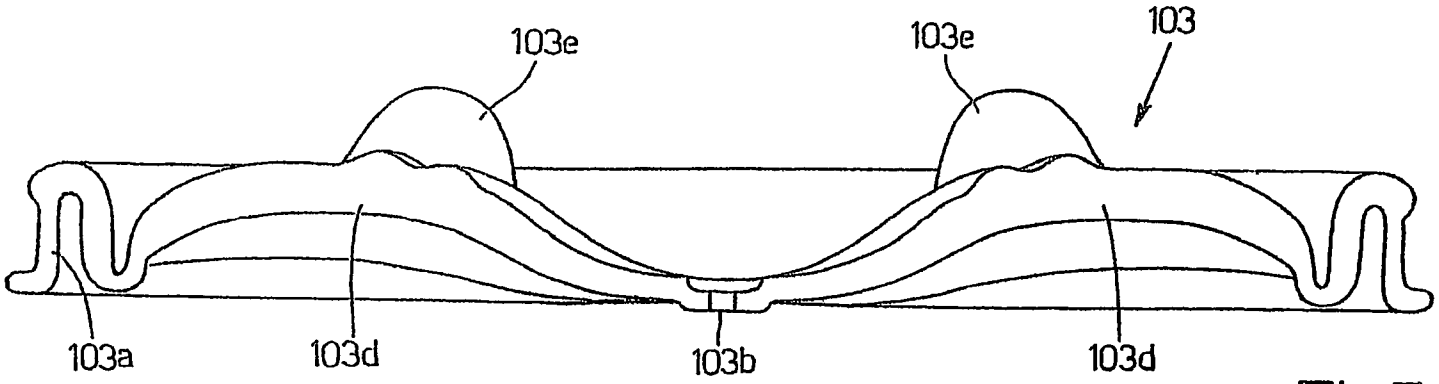
FIG. 7 shows a longitudinal section of the FIGS. 5 and 6 membrane.
Figure 8:
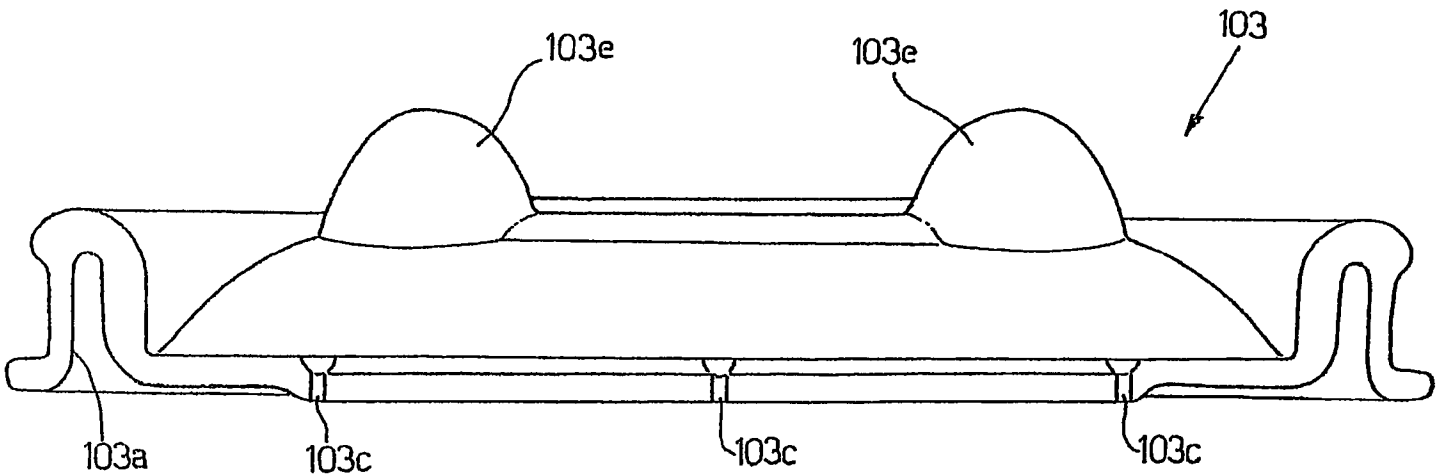
FIG. 8 shows a cross section of the FIGS. 5 and 6 membrane.
Figure 9:
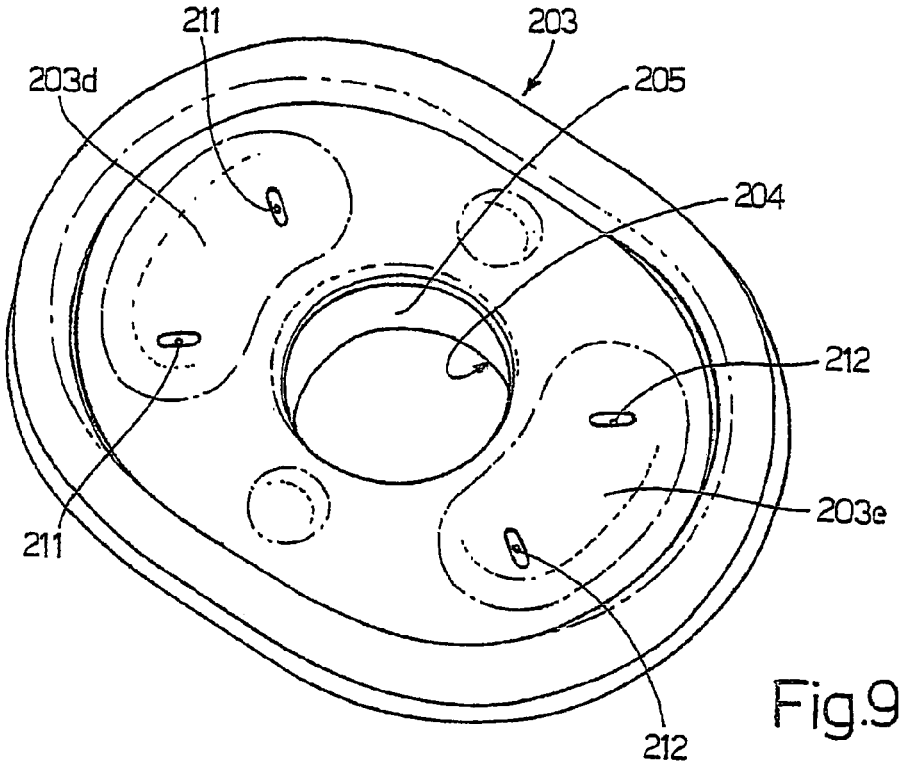
FIG. 9 shows a view in perspective of a second embodiment of a membrane usable in a handset as shown in FIG. 4.
Figure 10:
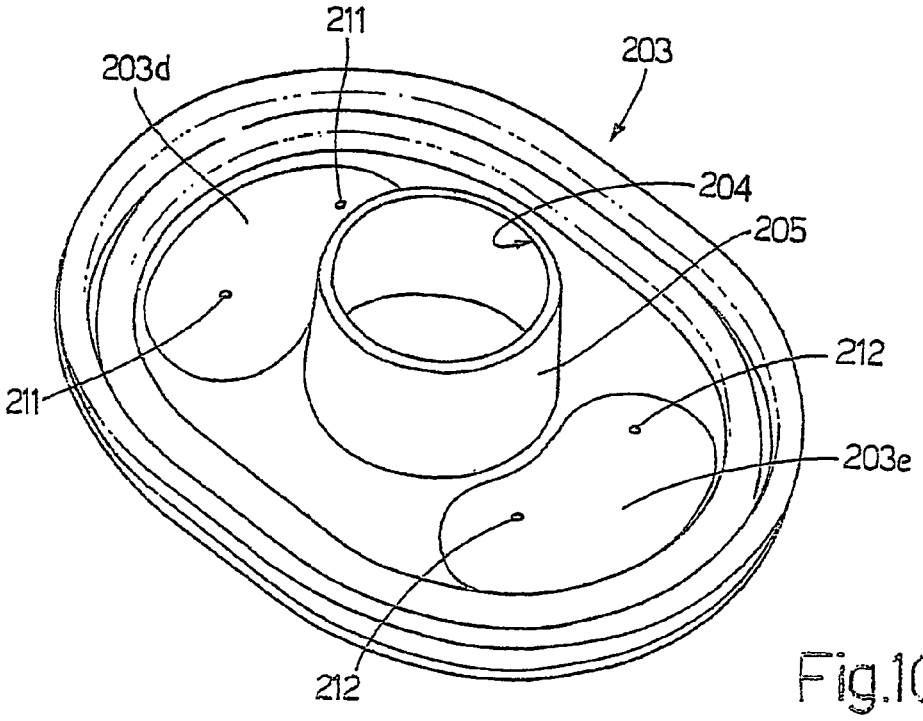
FIG. 10 shows a rear view of the FIG. 9 membrane.
Figure 11:
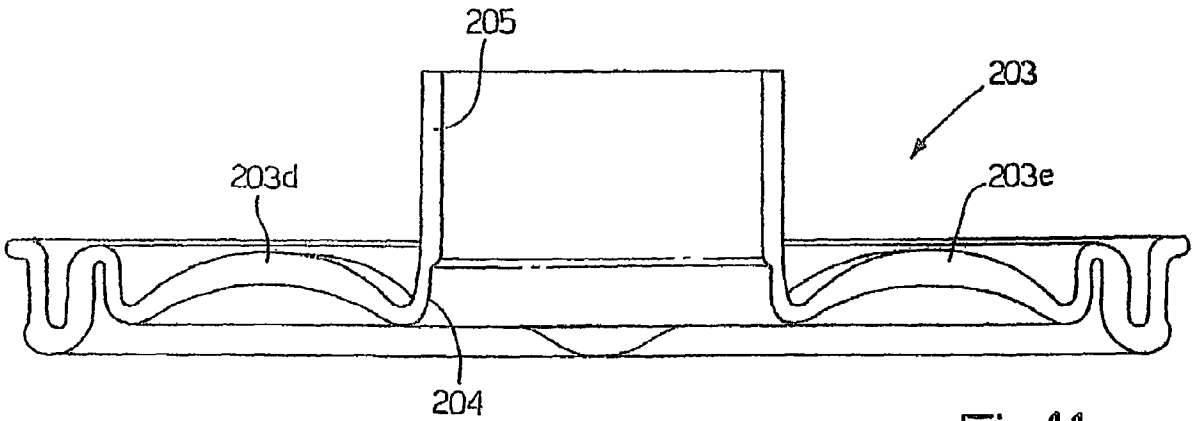
FIG. 11 shows a longitudinal section of the FIGS. 9 and 10 membrane.
Figure 12:
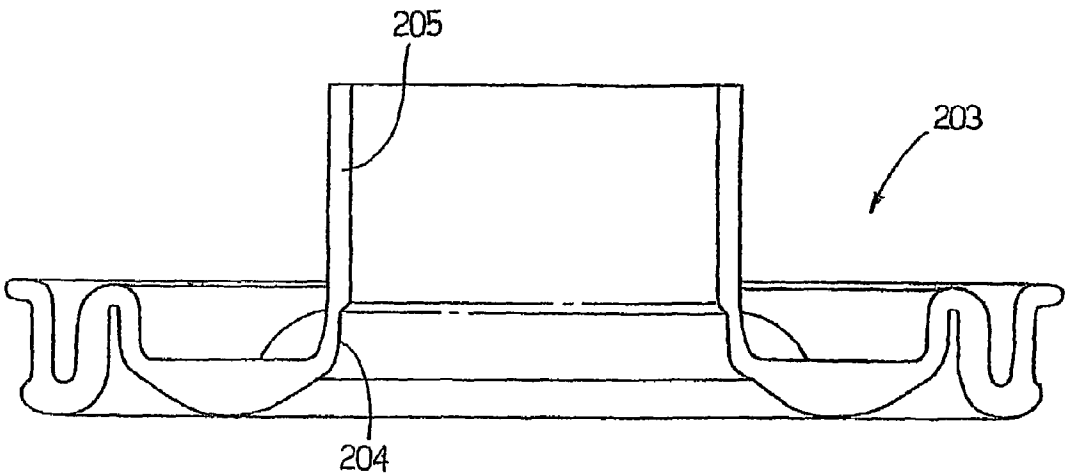
FIG. 12 shows a cross section of the FIG. 9 and 10 membrane.

As shown in FIG. 2 (and also FIG. 7), central portion 103*b*, on one side, and lateral portions 103*d*, 103*e*, on the other, of membrane 103 are curved slightly and oppositely concave. That is, central portion 103*b* is convex and the two lateral portions 103*d*, 103*e* concave with respect to the inside of chamber 102.

The form of membrane 103 is one of the basic characteristics of the present invention.

Figure 3:
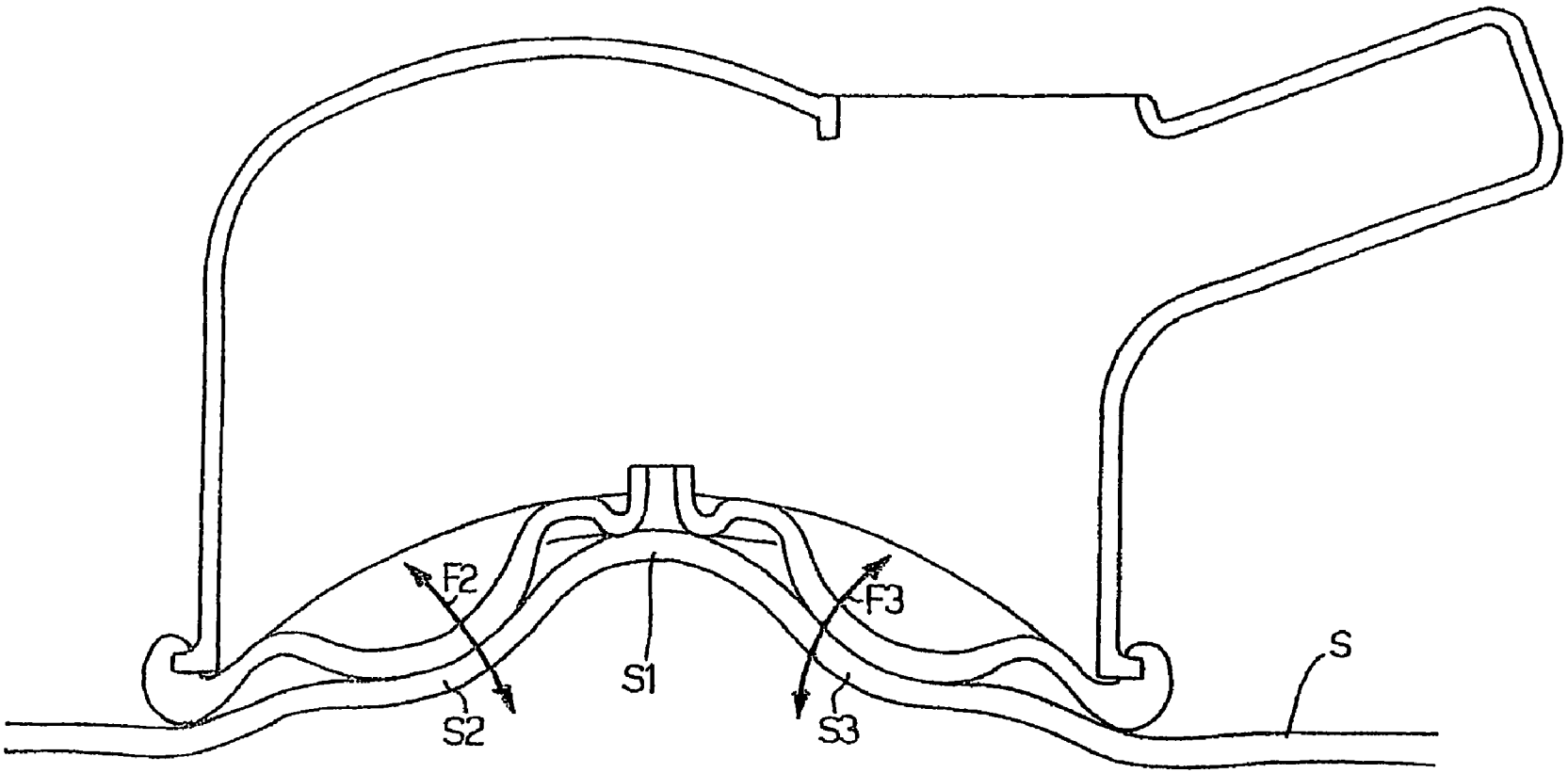
FIG. 3 shows the action performed by the FIG. 2 handset on a portion of a patient's skin.

With particular reference to FIG. 3, skin S is massaged as follows:

a portion S1 of skin S is lifted by the vacuum generated inside chamber 102, and which is transmitted to portion S1 through the three holes 103*c;* the portions S2, S3 of skin S adjacent to portion S1 are also lifted and subjected to the action of respective portions 103*d*, 103*e*, which are moved in the directions indicated by double arrows F2, F3 by the vacuum cycles inside chamber 102;

skin S is thus lifted, folded, compressed and smoothed to perform the massage cycle set by the operator by means of interface 17 and performed under the control of electronic central control unit 11.

Figure 4:
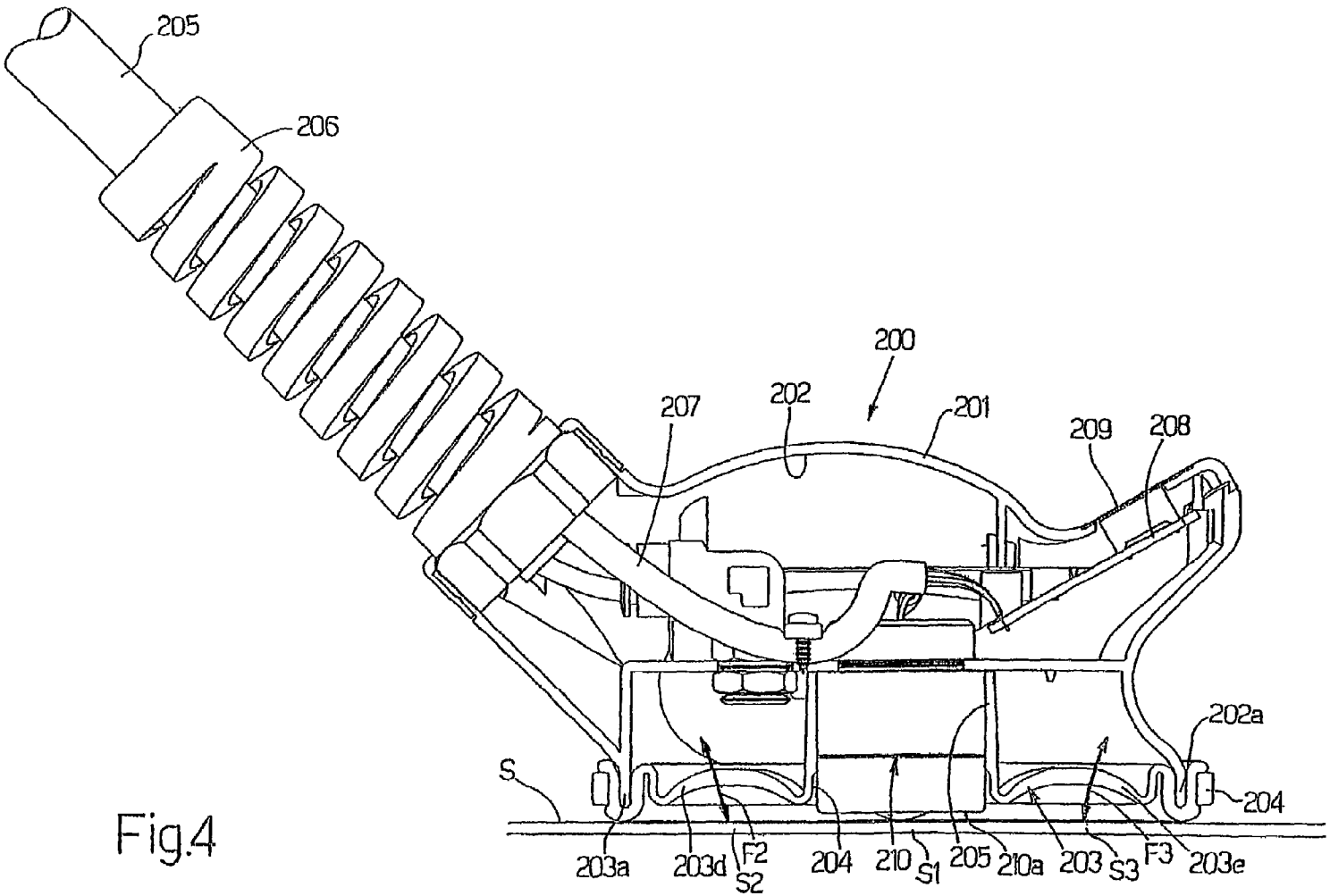
FIG. 4 shows a second embodiment of a handset of the FIG. 1 device.
Figure 5:
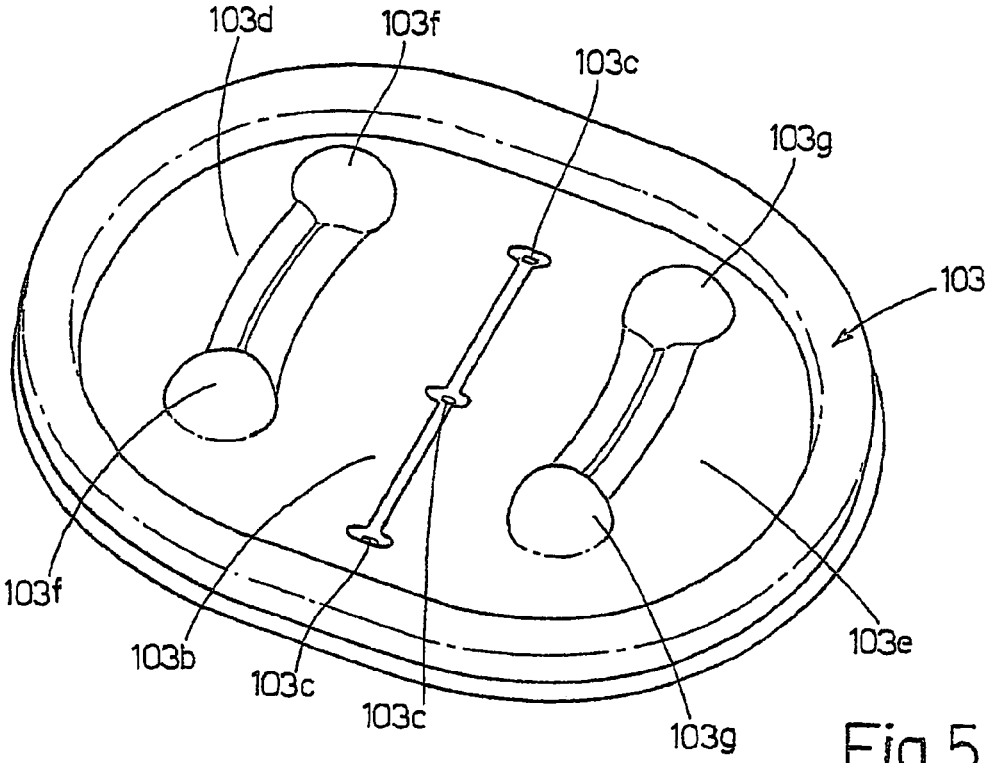
FIG. 5 shows a view in perspective of a first embodiment of a membrane usable in a handset as shown in FIG. 2.
Figure 6:
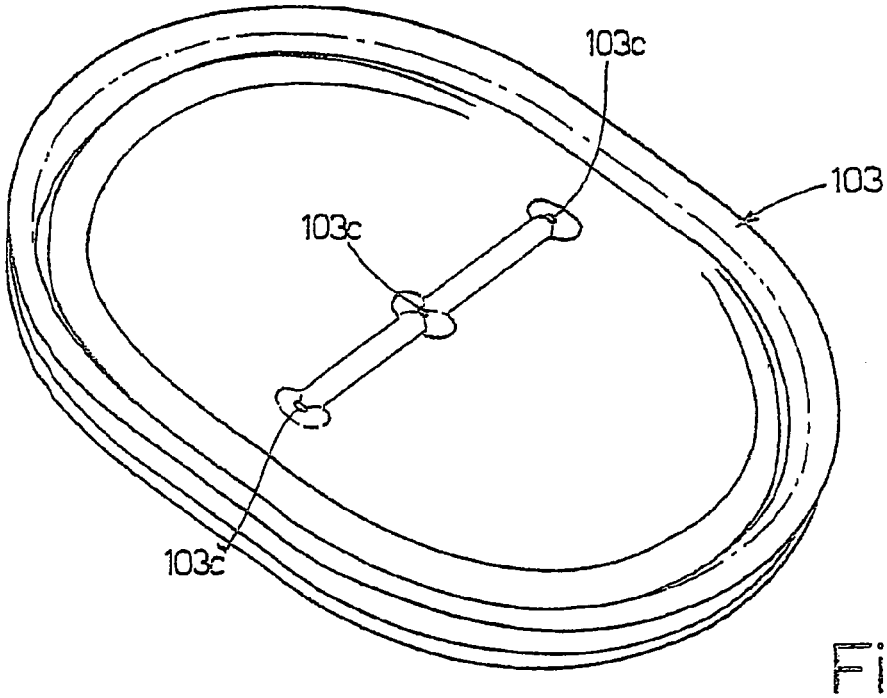
FIG. 6 shows a rear view of the FIG. 5 membrane.

FIG. 4 shows a second embodiment of the present invention.

Though numbered differently, the parts identical with those in the first embodiment shown in FIGS. 2 and 3 are easily recognizable and not described again.

In the second embodiment, a handset 200 comprises a main body 201 defining a chamber 202 closed by a membrane 203.

Membrane 203 comprises a central through hole 204 having a collar 205; and two lateral portions 203*d*, 203*e* which, like portions 103*d*, 103*e* in the first embodiment (FIGS. 2, 3, 5-8) move in the directions of double arrows F2, F3 to massage skin S.

In addition to powering display 208, electric cable 207 also supplies electric power to an ultrasound generating device 210 (comprising parts 18, 19 in FIG. 1*a*).

Device 210 is located centrally, and is therefore housed inside central through hole 204 and fixed to collar 205 by a ring nut (not shown).

As stated, in addition to the massage action performed by the two lateral portions 203*d*, 203*e* in the same way as in the first embodiment, this embodiment also exploits the beneficial effect of ultrasound emitted by device 210 through a surface 210*a* in direct contact with skin S.

As shown in FIGS. 4 and 9-12, however, portions 203*d*, 203*e* are convex inwards of chamber 202; each portion 203*d*, 203*e* has two holes 211, 212 respectively, to lift and treat portions S2, S3 of skin S as required; and portion S1 is subjected solely to the action of ultrasound device 210.

Membrane 203 therefore has projections and recesses by which to form, and exert a given pressure on, folds of tissue. Moreover, membrane 203 varies in thickness so as to yield differently at different points and so deform differently to further assist the formation of, and application of the desired pressure on, folds of skin.

The embodiment of handset 300 has substantially the same characteristics as handsets 100 and 200, and is therefore not described.

As stated, skin S is coated beforehand with lubricating oil to enable the operator, using handset 200, to slide membrane 203 and surface 210*a* of device 210 over skin S and so transmit the massage and toning action to the whole of skin S for treatment.125

The invention claimed is:

1. A skin massage device (10);

the device comprising a handset (100; 200; 300) connected to a machine body; said handset (100; 200; 300) in turn comprising a chamber (102; 202) closed by a deformable membrane (103; 203) which at least partly adheres to a patient's skin (S) by virtue of a vacuum generated in said chamber (102; 202) by a vacuum generating device (12) when the handset is placed over the skin to treat the skin;

wherein the device (10) comprises means (13) for producing a variable vacuum in said chamber (102; 202) to deform said membrane (103; 203) thereby lifting, folding, compressing, and smoothing the patient's skin (S);

wherein said membrane (103) comprises a central portion (103*b*) having a plurality of holes (103*c*) for lifting a portion (S1) of the skin (S); and two lateral portions (103*d*, 103*e*), thicker than said central portion (103*b*), which are movable by the vacuum generated inside the chamber (102);

wherein each of said lateral portions (103*d*, 103*e*) has two projections (103*f*, 103*g*);

wherein the central portion (103*b*) extends transversely across a surface of the membrane (103) between the two lateral portions (103*d*, 103*e*); and wherein the plurality of holes (103*c*) of the central portion (103*b*) are aligned and spaced from one another between the two lateral portions (103*d*, 103*e*); and wherein the membrane has a peripheral groove (103*a*) into which a bottom edge (102*a*) of the chamber is inserted such that only the membrane contacts the skin when the handset is placed over the patient's skin.

2. A device (10) as claimed in claim 1, wherein said membrane (103; 203) is disposable separately from said device.

3. A device (10) as claimed in claim 1 ,wherein said handset (100; 200; 300) has means for activating and programming said device.

4. A device (10) as claimed in claim 3, wherein said means (11) for activating and programming said device is programmable to perform pulsating treatment cycles of a patient's skin (S) as determined by an operator.

5. A device as claimed in claim 1, wherein each of said lateral portions has through holes by which to lift and treat the skin.

6. A device according to claim 1, wherein the central portion (103*b*) has one central hole and two lateral holes which are aligned and spaced from one another between the two lateral portions (103*d*, 103*e*).

7. A device according to claim 1, wherein the central portion (103*b*) and the two lateral portions (103*d*, 103*e*) are substantially aligned with one another.

8. A device according to claim 1, wherein the two lateral portions (103*d*, 103*e*) extend transversely across a surface of the membrane (103) and the two projections (103*f*, 103*g*) of each of the two lateral portions (103*d*, 103*e*) are spaced transversely from one another.

9. A device according to claim 8, wherein the projections (103*f*, 103*g*) of the lateral portions (103*d*, 103*e*) are substantially dome-shaped.

10. A device according to claim 1, wherein the central portion is convex with respect to the chamber (102; 202) and the lateral portions (103*d*, 103*e*) are concave with respect to the chamber (102; 202).

11. A device according to claim 10, wherein the projections (103*f*, 103*g*) of the lateral portions (103*d*, 103*e*) form knuckles over the concave lateral portions (103*d*, 103*e*).

12. A skin massage device; the device comprising a handset connected to a machine body; said handset in turn comprising a chamber closed by a deformable membrane which at least partly adheres to a patient's skin by virtue of a vacuum generated in said chamber by a vacuum generating device when the handset is placed over the skin to treat the skin;

wherein the device comprises means for producing a variable vacuum in said chamber to deform said membrane thereby lifting, folding, compressing, and smoothing the patient's skin;

wherein the membrane comprises:

a central portion;

a first lateral portion;

a second lateral portion; and a plurality of projections;

wherein the central portion extends traversely across a surface of the membrane and defines a plurality of holes spaced from one another aligned along a central axis such that, when the variable vacuum is generated, a lifting force is generated through the holes in a vertical direction in the central portion only; and wherein each of the plurality of projections is aligned either on the first lateral portion on a first side of the central portion or on the second lateral portion on a second, opposite side of the central portion whereby to form a first set of projections and a second set of projections, and wherein each of the lateral portions is offset from the central portion such that, when the variable vacuum is generated and skin is lifted in the vertical direction through the holes in the central axis, each of the first set of projections moves in a first oblique direction with respect to the vertical direction and each of the second set of projections moves in a second oblique direction with respect to the vertical direction with the first and second set of projections moving toward each other to pinch the skin.

13. A skin massage device according to claim 12, wherein the lateral portions have no holes.

* * * * *

UNITED STATES PATENT AND TRADEMARK OFFICE

CERTIFICATE OF CORRECTION

PATENT NO. : 7,682,321 B2
APPLICATION NO. : 10/552294
DATED : March 23, 2010
INVENTOR(S) : Moreno Naldoni It is certified that error appears in the above-identified patent and that said Letters Patent is hereby corrected as shown below:

On the Title page, Item (73) Assignee: "Montespoertoli" should read --Montespertoli--

Signed and Sealed this

Seventh Day of December, 2010

David J. Kappos

David J. Kappos
*Director of the United States Patent and Trademark Office*